US007549381B1

(12) United States Patent
Nail, Jr. et al.

(10) Patent No.: US 7,549,381 B1
(45) Date of Patent: Jun. 23, 2009

(54) RUGGED MODULAR OPERATIONS TABLE

(76) Inventors: Curtis L. Nail, Jr., 2324 Magna Carta Pl., Huntsville, AL (US) 35803; Roger A. Garrison, 1103 7th Ave. NE., Arab, AL (US) 35016

( * ) Notice: Subject to any disclaimer, the term of this patent is extended or adjusted under 35 U.S.C. 154(b) by 228 days.

(21) Appl. No.: 10/898,271

(22) Filed: Jul. 23, 2004

(51) Int. Cl.
*A47B 3/00* (2006.01)

(52) U.S. Cl. ..... 108/132; 248/439; 108/26

(58) Field of Classification Search ..... 108/147.21, 108/115, 116, 50.02, 50.01, 132, 129, 36, 108/38, 34, 35, 25, 26; 248/188.6, 188.5, 248/439; 312/223.6
See application file for complete search history.

(56) References Cited

U.S. PATENT DOCUMENTS 2,542,394 A * 2/1951 Cohen et al. ..... 108/36
2,872,252 A * 2/1959 Konkle ..... 108/147.21
3,661,100 A * 5/1972 Tennant ..... 108/132
3,701,506 A * 10/1972 Favreau ..... 248/188.5
4,103,626 A * 8/1978 Barricks ..... 108/127
4,111,482 A * 9/1978 Jones ..... 108/36
4,143,601 A * 3/1979 Pike ..... 108/35
4,191,111 A * 3/1980 Emmert ..... 108/132
4,415,149 A * 11/1983 Rees ..... 269/88
4,500,150 A 2/1985 Leibensperger et al.
4,658,735 A * 4/1987 Holton ..... 108/131
4,715,296 A * 12/1987 Wilkinson ..... 108/116
4,734,826 A 3/1988 Wilson et al.
4,838,175 A 6/1989 Hauville
5,161,590 A 11/1992 Otto
5,217,125 A * 6/1993 Swanson ..... 211/195
5,231,562 A 7/1993 Pierce et al.
5,640,912 A * 6/1997 Diffrient ..... 108/50.02
5,829,501 A 11/1998 DeVito
6,019,321 A * 2/2000 Carlson et al. ..... 312/223.6
6,044,775 A * 4/2000 Lashlee et al. ..... 108/132
6,059,385 A 5/2000 Guhl
6,253,688 B1 * 7/2001 Lor ..... 108/132
6,254,206 B1 * 7/2001 Petrick et al. ..... 312/223.6
6,282,084 B1 8/2001 Goerdt et al.
6,415,723 B1 * 7/2002 Kopish et al. ..... 108/50.02
6,435,106 B2 8/2002 Funk et al.
6,493,217 B1 12/2002 Jenkins, Jr.
6,675,722 B2 1/2004 Stathis et al.
6,905,166 B2 * 6/2005 Zhurong et al. ..... 108/132
6,945,178 B1 * 9/2005 Nye et al. ..... 108/132
7,055,563 B2 * 6/2006 Logan ..... 108/132

* cited by examiner

*Primary Examiner*—José V Chen
(74) *Attorney, Agent, or Firm*—Mark Clodfelter

(57) ABSTRACT

A foldable and stackable operations table is provided with channels underneath the table top, the channels defined by longitudinally extending rails and a side member integral with the top. Elongated rectangular boxes containing electronic components and associated wiring are sized to fit within the channels. Connectivity of components inside the boxes with external devices is enabled by receptacles provided in a lower side of the box. The table has three equal sized channels for receiving boxes, which may be media boxes or a combination of one or two media boxes with a cable storage box. All of the boxes are also equal in size so that they be readily replaced for one another. Legs of the table are independently adjustable in height. Multiple tables may be connected together for larger scale operation.

3 Claims, 6 Drawing Sheets

RUGGED MODULAR OPERATIONS TABLE

FIELD OF THE INVENTION

This invention relates to foldable tables for use as computer work stations in remote field operations where quick setup and teardown are important factors, and in other environments requiring wiring management and distribution of services for related devices such as servers, printers and copying machines.

BACKGROUND OF THE INVENTION

Computer systems typically involve handling of a multitude of connecting wires for the computer as well as for related devices requiring electric power. Wires and cables are also required for telephone, video and fiber optic devices. The resulting array of wires frequently becomes cumbersome, time consuming and confusing to the user. A solution in the form of improved wiring management, coupled with effective distribution of services for all devices in the system is needed.

SUMMARY OF THE INVENTION

The present invention is directed to a foldable and stackable operations table provided with channels underneath a table top, the channels configured to receive and support enclosures in the form of rectangular boxes in which active electronic components and connecting cables are installed (media boxes) or inactive cables or parts may be stored (storage boxes). Side edge members perpendicular to the top surface are disposed downward from the top around the periphery of the table, providing outer sides of outer channels. Spaced-apart rails defining inner sides of channels are connected to the underside of the table top. In a typical configuration three rails may be used, providing three channels of equal width in one direction and a fourth, narrower channel adjacent the side member in the opposite direction. The fourth channel communicates with an opening at a central location, and through which cables may be routed from connections on the electronics devices on the table top to connections on the media boxes coupled to wiring therein.

The table has a foldable leg assembly at each end, preferably in the form of an H-style structure in which both legs at each end are movable as a unit, with the legs connected to a circular pipe rotatably supported by U-straps. When folded up the legs are placed in position to provide flat upper surfaces upon which other folded tables may be stacked.

Enclosures for placement in the channels may be of equal size, enabling rapid substitution and use of enclosures with different components, depending on different requirements. The enclosures fit within the channels and have top, bottom, end and side plates, with apertures in the bottom plate to allow access to receptacles by cable plugs or other connecting components. Connection of the enclosures to the lower side of the table top may be obtained by providing threaded studs mounted on the underside of the top, and also providing flanges on the top plate with apertures which allow the flanges to be placed over the studs, and securing the enclosure by engaging the threaded studs by application of threaded knobs.

Subsurface channels and studs with matching knobs enable different styles and combinations of media boxes or cable storage boxes to be attached to the underside of the table. This allows the table to be scaleable to fit a customer's requirements.

All of the media boxes and cable storage boxes are modular in nature, being removable as a unit, and are subject to be replaced by boxes configured for different purposes. For example, some boxes may provide connectivity for power, LAN (local area network) and telephone/video over CAT5E cable, along with capability for handling other components. Another configuration may provide a power only version of the media box. The advantage of this removable, reconfigurable approach is to allow for easy repair by quickly replacing the media box and to allow for multiple configuration options.

It is therefore an object of this invention to provide a table assembly wherein enclosures containing installed components may be connected to and disconnected from the assembly as a unit.

Another object is to provide a tactical operations table in which wires and cables are contained to a maximum extent within removable modular enclosures.

Yet another object is to provide an operations table that is compact in size and readily foldable and stackable.

Other objects and advantages will be apparent from the following description and the appended claims.

DESCRIPTION OF THE PREFERRED EMBODIMENT

Figure 1:
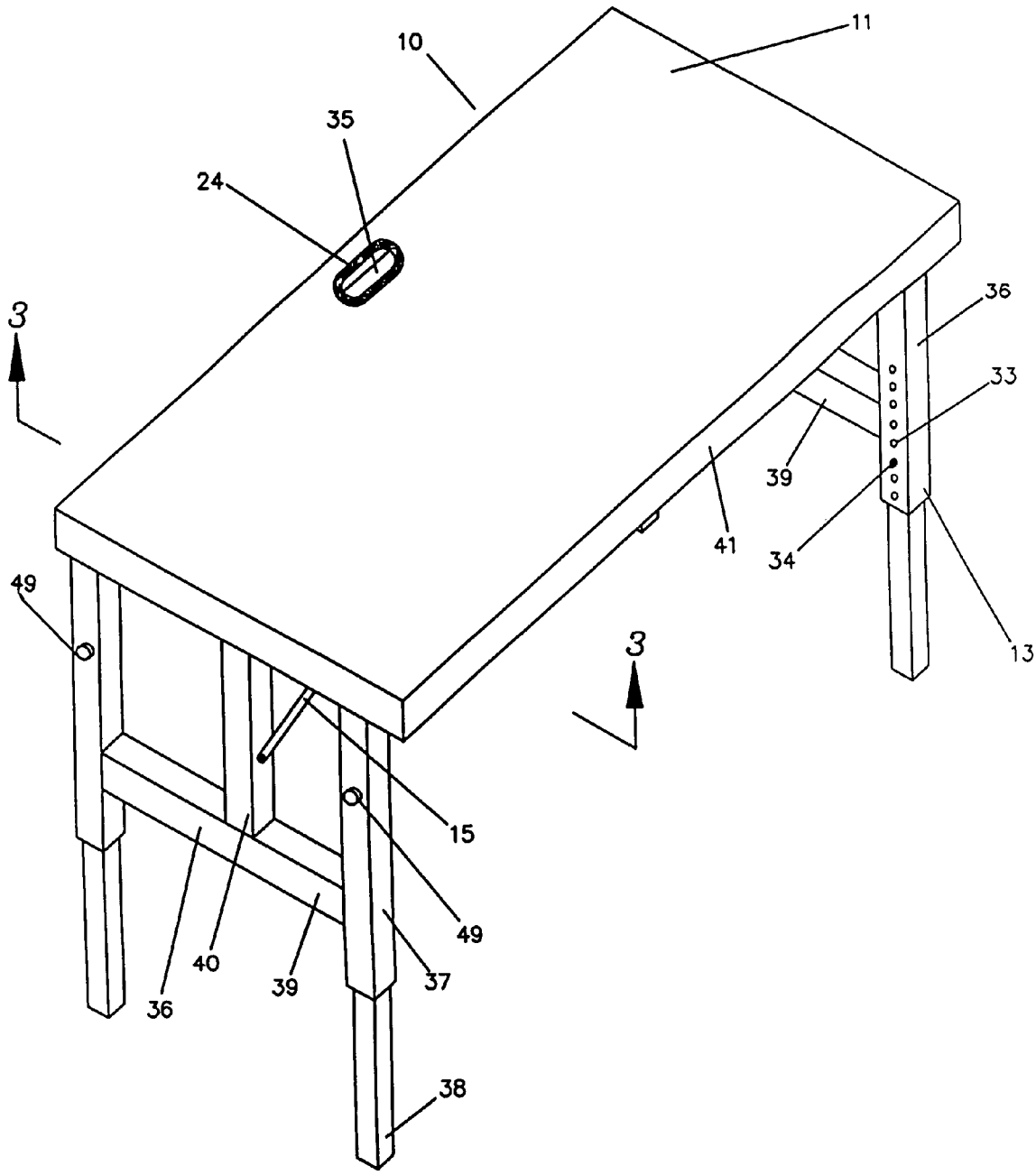
FIG. 1 is an isometric view of an operations table embodying the invention, this view taken from above.
Figure 2:
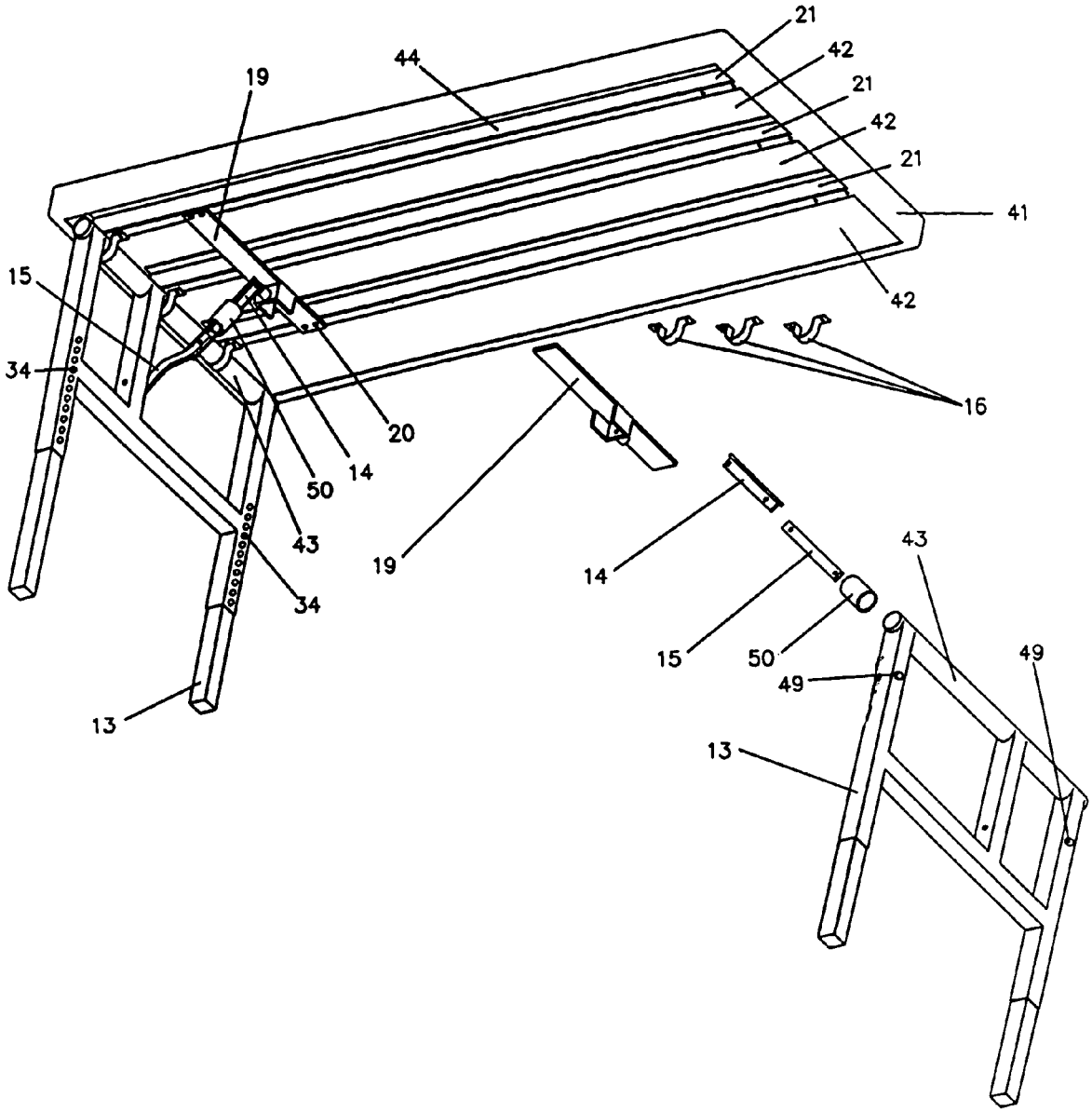
FIG. 2 is an isometric view, partially exploded, showing structure of the table from below, without any boxes installed.

Referring to FIGS. 1 and 2 there is shown framework of a rugged modular operations table 10 configured to carry in modular boxes components for providing electrical connectivity and for performing other functions within the boxes. The table may be rectangular and has a flat top made of material such as an aluminum sheet, folded over around the edges to form a vertically extending outer wall 41. An opening 35 for passage of connecting cables is provided at location near a side edge and at a point half way along the length of the table. An outer side 24 of the passage also serves to be used as a handle when the table is being moved.

Figure 6:
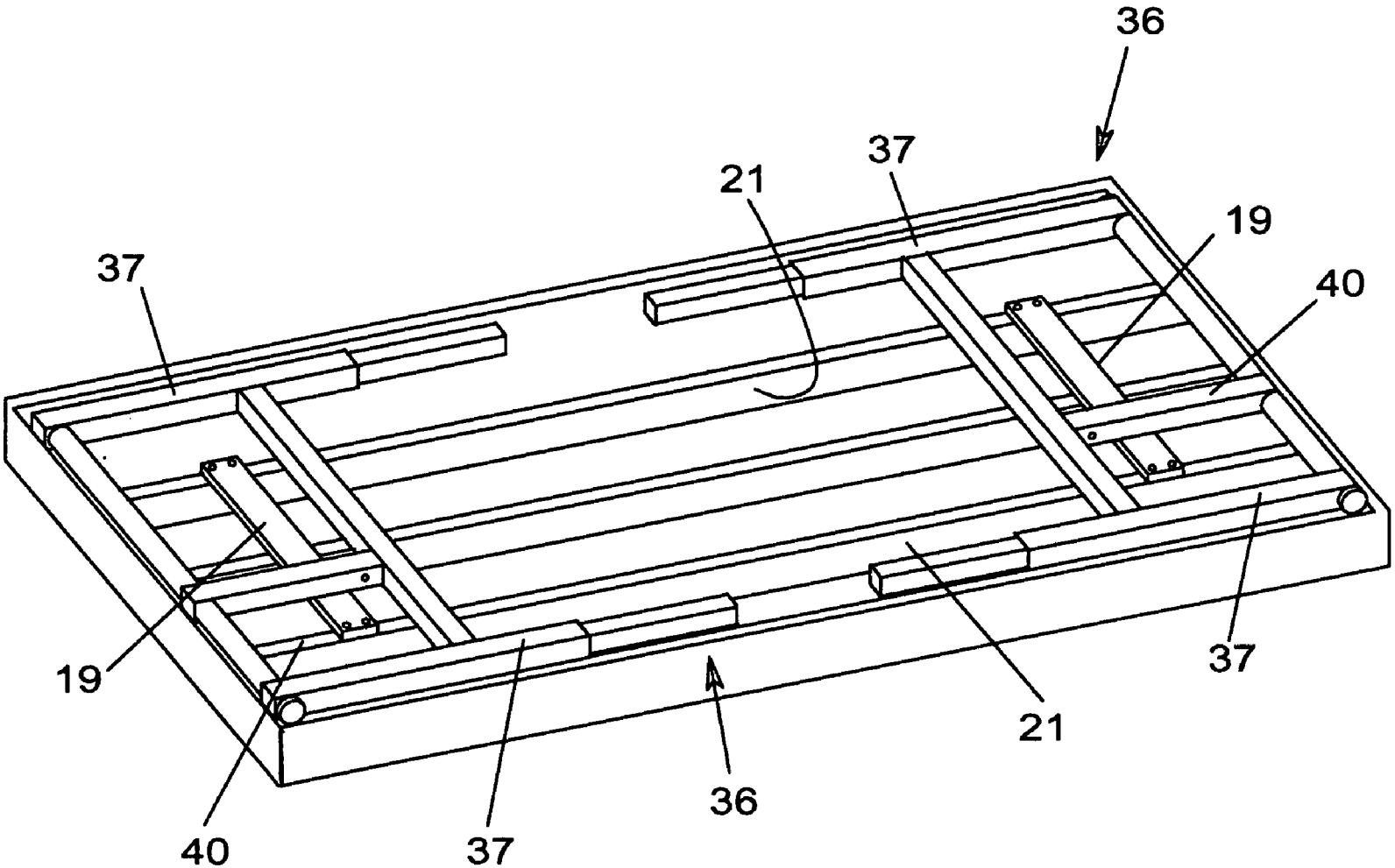
FIG. 6 is an isometric view taken from below and showing the legs in a folded configuration in order to facilitate stacking of the tables.

A pair of leg assemblies 36 are pivotally connected to the table, one at each end, ands are configured to be folded inward, forming a thin profile amenable to stacking. Each of the assemblies may have a top member 43 with a circular cross section, mounted for rotation within a plurality of U-straps 16, each one connected to the bottom of an elongated C-channel member 21. A pair of legs 13 are connected to ends of the circular member, one to each end, the legs being preferably made of square tubing and having an upper portion 37 and a lower portion 38. The legs are connected to a cross member 39, which in turn may be connected to a vertical member 40, extending upward to a connection with circular member 43. Each of the legs has a bumper which may take the form of a button 49 located near the top of the leg on a side which extends upward when the leg is folded down. This measure serves to protect the leg from being scratched or damaged when stacked. As shown in FIG. 6 (shown without media boxes for clarity), when leg assemblies 36 are folded or placed in their storage position for stacking or shipping, upper, flat surfaces 37 of leg assemblies 36 conveniently allow a plurality of tables to be stacked. This configuration is facilitated by vertical members 40 of leg assemblies 36 abutting weldment plate 19, and circular members 43 being connected to outer edges of channel-forming members 21, which places leg assemblies 36 outside of the channels formed by channel members 21.

Each of the legs may be provided with capability for adjustment to enable rapid leveling of the table when being deployed on rough terrain. As shown in FIG. 1 a series of vertically spaced-apart holes 33 are provided in upper leg portion 37. The lower portion 38 of the leg may be slid up or down to obtain a selected level, which can be held in place by insertion of a spring-driven button 34, into a mating hole in upper portion 37. Height of the table may be adjusted for the table shown from 25.5 inches to 35.5 inches to provide an optimum ergonomic work surface and for leveling.

Folding and unfolding of the legs for storage and deployment may be enabled by a mechanism including a T-bar 14 having a top end mounted on a weldment bar 19 removably connected to outer C-channel members 21 and a lower end pivotally connected to the upper end of a Z-bar 15, which in turn has a lower end connected to vertical member 40. A locking collar 50 is disposed around T-bar 14 in a position where the collar slides down the T-bar by gravity and holds the T-bar and the Z-bar in alignment, thus keeping the leg assembly from folding up until the collar is slid upward.

Figure 3:
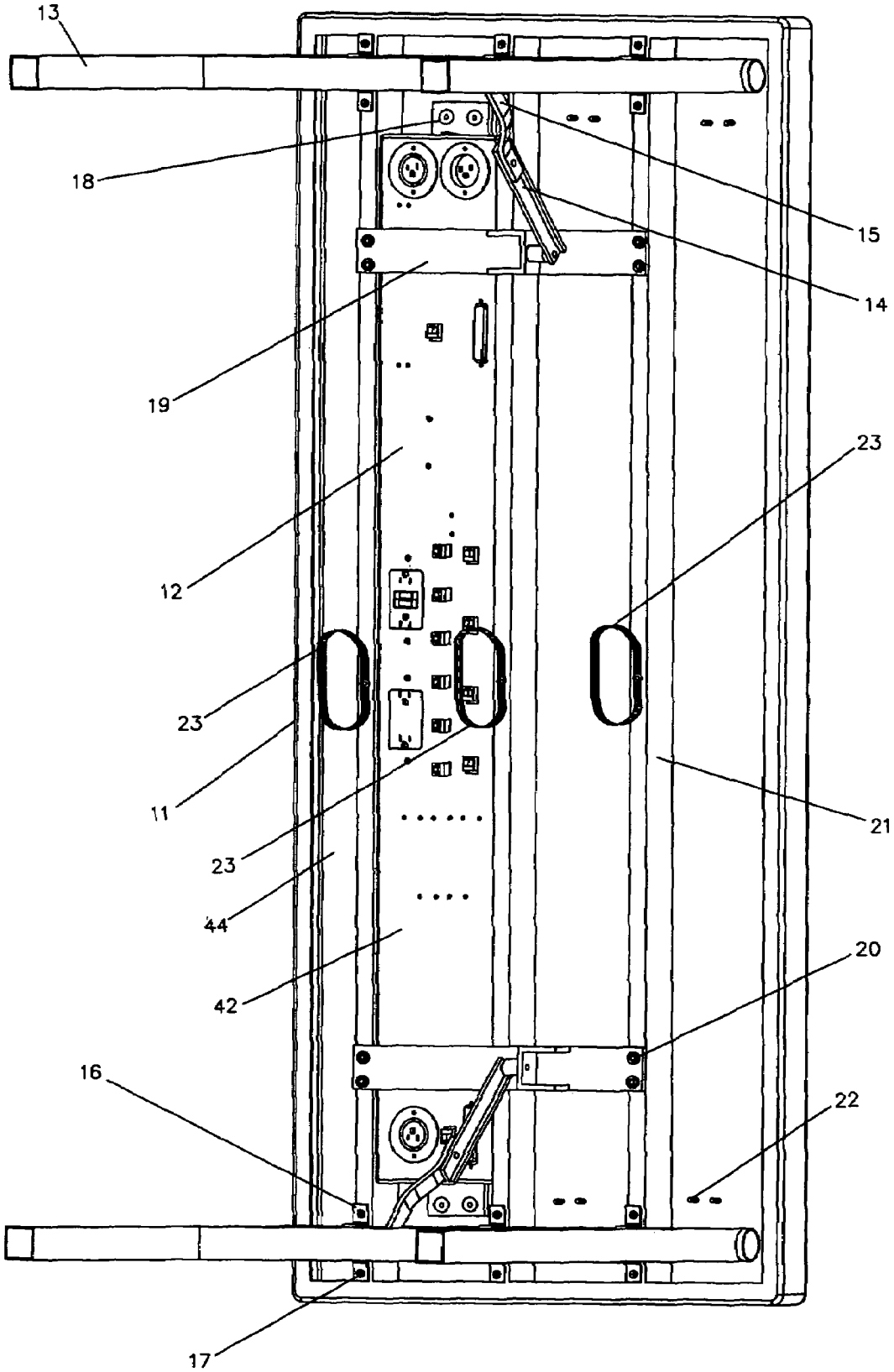
FIG. 3 is an isometric view of the table taken from below in accordance with line 3-3 of FIG. 1, with a single media box installed.
Figure 4:
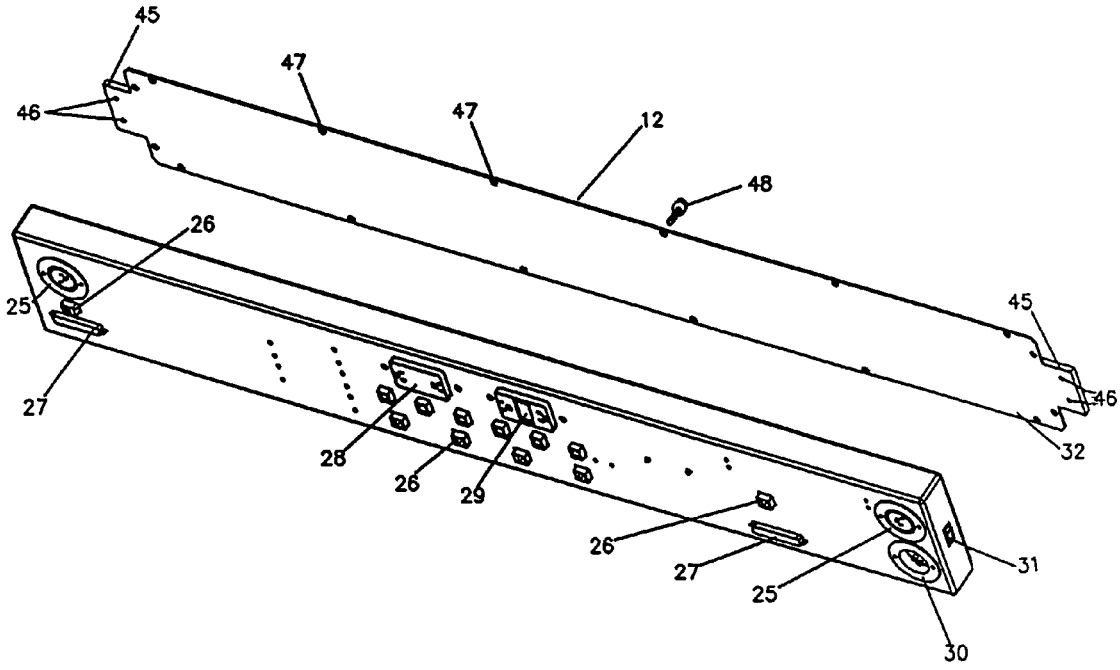
FIG. 4 is an isometric view of an equipped media box, taken from below, with a lid therefor spaced apart.

FIG. 3 shows a media box 12 installed in a channel 42 extending longitudinally between C-channel members 21 underneath the table top. The media box as shown in FIG. 4 has a lid 32 secured by screws 48 connected to sides of the media box through holes 47. At each end the lid has a narrowed flange 45 provided with holes 46 which are positioned over threaded studs 22 connected to the underside of the top. Threaded knobs 18 are manually screwed onto the studs to secure the media box in position. It is noted that in order to replace a media box in a channel underneath the weldment bars these bars must first be unbolted and moved temporarily to allow room for inserting or removing the media box.

FIG. 3 also shows Velcro straps 23 attached to bottom portions of channel forming members 21 at central locations in line with opening 35 (FIG. 1) through which cables are fed. This enables cables and any other wiring to be held neatly and kept from becoming tangled. Additional straps may be provided at other locations, in particular at one or both ends.

An example of a media box providing electrical connectivity for a specific application is illustrated by the box shown in FIG. 4. This media box enables connections for power, LAN and phone/video over CAT5E cable. At one end of the box a 120 VAC flanged outlet 25, a RJ-45 coupler device 26 and a Telco 50 connector 27 are located, and at the other end a second flanged outlet 25 and a 120 VAC flanged inlet 30 are placed on the lower side and a circuit breaker 31 is provided on an end position perpendicular to the sides. Several more RJ-45 couplers 26 are placed near the center of the box, along with a 110 VAC duplex receptacle 28 and a 110 VAC Ground Fault Circuit Interrupter duplex receptacle 29. This media box provides connectivity for two operators. Each operator has one duplex outlet, two GB Ethernet ports and one phone/video port, which is a standard configuration. Power is GFCI and circuit-breaker protected. A Gigabit Ethernet switch is built in to support easy configuration and needed bandwidth for network intensive operations. Additional jacks provide connectivity for phones or video. The box can be reversed in the table to allow the input cabling to come from either side and can be easily removed by turning the four threaded knobs. Media boxes as described above are designed to be connected in series or parallel with short jumper cables.

Figure 5:
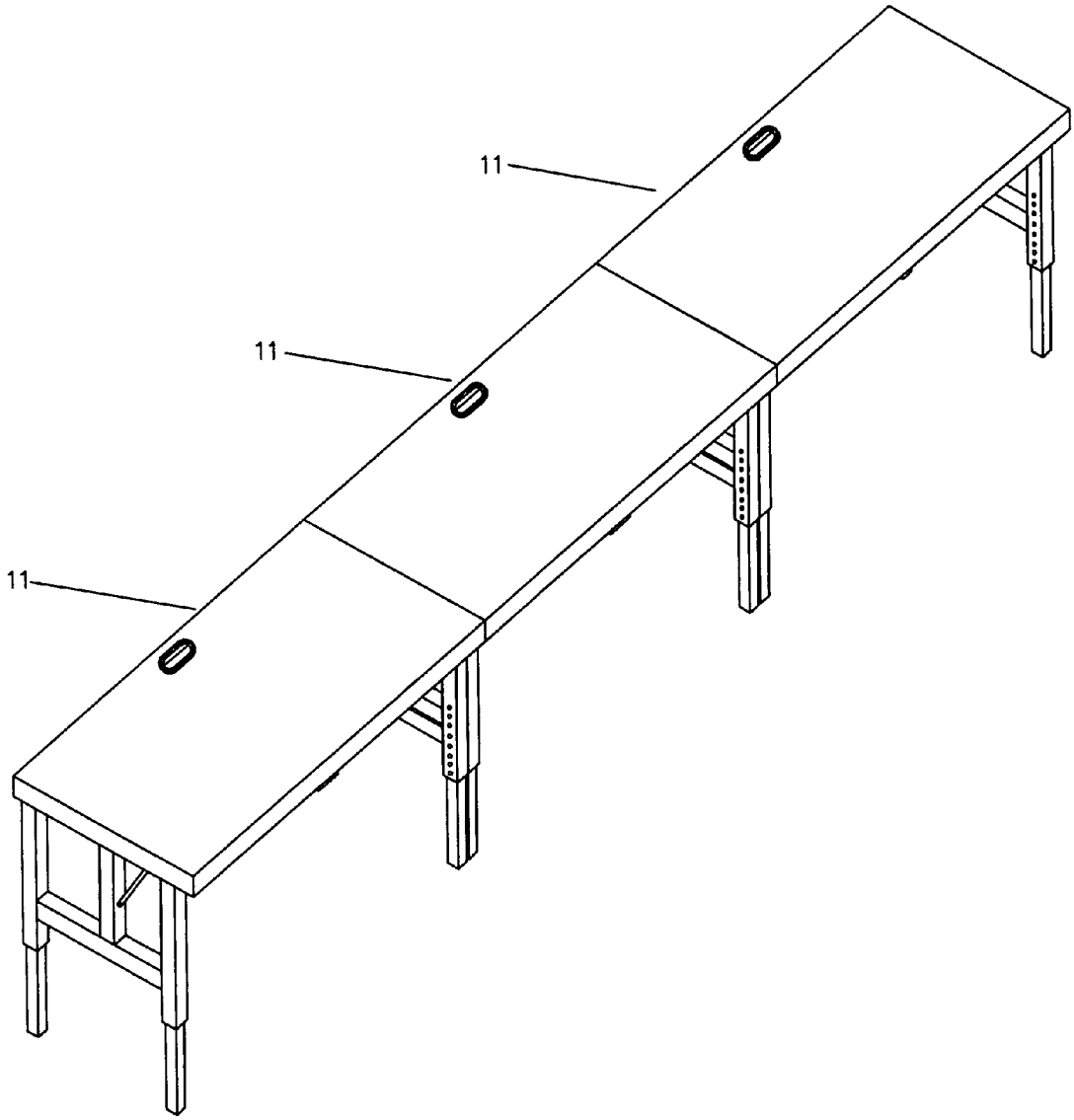
FIG. 5 is an isometric view, taken from above, showing an array of three tables connected together.

FIG. 5 is directed to an array of three tables aligned and interconnected by cables (not shown). The tables may be combined in this manner for use in larger scale operations A cable storage box may be located in a channel underneath the table in combination with one or two media boxes, the storage box having the same external dimensions and attachment features as a media box. Short electrical jumper cables used to daisy chain media boxes may be placed in the storage box, along with small devices such as laptop power supplies, USB hubs and external storage media.

Although the invention is not limited to specific dimensions, it is preferred to make the table compact in size, for example, 59 inches long, 29 inches wide and foldable to a thickness of 4 inches. This enables easy stacking and handling, along with rapid deployment.

In addition to use of tables embodying the invention for complex and diverse requirements in tactical operations centers, numerous other applications may be found for situations involving wiring management and distribution of services. The table can support laptop computers, servers, printers, and other electronic devices. It is highly versatile and can be used in tent complexes, shipboard spaces, buildings and for schools and universities, as well as for businesses.

The invention claimed is:

1. A table assembly comprising:

an elongated rectangular table top having an upper surface and a lower surface;

at least one side edge member disposed downward from said lower surface around the periphery of said table top;

a plurality of spaced-apart rails connected to said lower surface, said at least one side edge member and said plurality of spaced-apart rails defining a plurality of channels extending longitudinally along the length of the underside of said table top, said plurality of channels comprising at least one outer channel having an outer side provided by said at least one side edge member;

at least one enclosure configured for removable mounting in a one of said plurality of channels, said enclosure further configured to provide pluggable connectivity between one or more electronic devices on said table top and at least power and data sources; and, legs incorporated in a pair of folding leg assemblies, one said folding leg assembly at each end of said table and supporting said table top, said folding legs configured to remain outside each of said plurality of channels and to provide a flat surface upon which others of said table assemblies can be stacked when said folding legs are in their folded position, said leg assemblies each further comprising:

a top member having a circular cross-section mounted for rotation within a plurality of U-straps, one of each said U-straps connected to a lower surface of one of each of said rails, a leg connected on each end of said top member, each of said legs comprising rectangular metal tubing, a cross member connected between each said leg of a respective leg assembly of said leg assemblies, each said cross member contacting said rails when a respective said leg assembly is folded, thereby providing said flat surface upon which others of said table assemblies can be stacked, a vertical member connected between said cross member and said top member.

2. A modular operations table assembly comprising, one or more enclosures containing electronic components and associated wiring;

an elongated rectangular table top having an upper surface and a lower surface;

at least one side edge member disposed downward from said lower surface around the periphery of said table top;

a plurality of spaced-apart rails connected to said lower surface, said at least one side edge member and said plurality of spaced-apart rails defining a plurality of channels extending along the length of said top, said plurality of channels comprising at least one outer channel having an outer side provided by said at least one side edge member;

at least one of said one or more enclosures being removably mounted in a one of said plurality of channels; and foldable legs supporting said table top, said foldable legs being configured to remain outside each one of said plurality of channels and to provide flat surfaces upon which other of said modular operations table assemblies can be stacked when said foldable legs are in their folded position, and, a cross member between said legs at each end of said modular operations table, said cross member contacting said rails and limiting folding movement of said legs to a plane outside said channels so as to provide said flat surfaces on an outer bottom side of said table when said legs are in a folded position.

3. An operations table configured to provide access to electrical power and data signals to a plurality of types of electronic devices placable on said operations table, said electronic devices including computers, computer-related devices and telephonic devices requiring connectivity to sources such as data, video and telephonic sources, said operations table comprising:

a table surface having an upper side upon which said electronic devices are placed, said table surface having a lower side further comprising;

at least one side edge member disposed downward from said lower side around the periphery of said operations table;

a plurality of spaced-apart rails attached to said lower side and extending lengthwise along said lower side, said at least one side edge member and said plurality of spaced-apart rails defining a plurality of channels, said plurality of channels comprising at least one outer channel having an outer side provided by said at least one side edge member;

at least one enclosure removably mounted in a one of said plurality of channels, said enclosure having at least one power input plug for receiving said electrical power and at least one input data plug for receiving said data signals as inputs, and further having electrical power distribution plugs and data signal output distribution plugs for providing said electrical power and said data signals as outputs;

foldable legs supporting said table top, said foldable legs being configured to remain outside each one of said plurality of channels and to provide a flat surface upon which other of said operation tables can be stacked when said foldable legs are in their folded position, and, a cross member connected between said legs, said cross member contacting said rails when said legs are folded, limiting said legs to a position outside said channels and providing said flat surface upon which said other of said operations tables can be stacked.

* * * * *